US005835833A

United States Patent [19]

Dalal et al.

[11] Patent Number: 5,835,833

[45] Date of Patent: Nov. 10, 1998

[54] DUAL OIL RELEASE AGENT MANAGEMENT SYSTEM

[75] Inventors: Edul N. Dalal, Webster; Robert J. Gruber, Pittsford; Rabin Moser, Victor, all of N.Y.

[73] Assignee: Xerox Corporation, Stamford, Conn.

[21] Appl. No.: 4,644

[22] Filed: Jan. 8, 1998

[51] Int. Cl.[6] ..... G03G 15/20

[52] U.S. Cl. ..... 399/325; 399/324; 118/DIG. 1

[56] References Cited

U.S. PATENT DOCUMENTS

| | | | |
|---|---|---|---|
| 3,934,547 | 1/1976 | Jelfo et al. | 118/60 |
| 4,065,585 | 12/1977 | Jelfo et al. | 427/11 |
| 4,214,549 | 7/1980 | Moser | 118/60 |
| 5,017,432 | 5/1991 | Eddy et al. | 428/422 |
| 5,217,837 | 6/1993 | Henry et al. | 430/124 |
| 5,219,612 | 6/1993 | Bingham et al. | 427/194 |
| 5,500,722 | 3/1996 | Jacobs . | |
| 5,531,813 | 7/1996 | Henry et al. | 106/2 |

*Primary Examiner*—Matthew S. Smith

[57] ABSTRACT

A heat and pressure fuser and Release Agent Management (RAM) systems therefor. Dual RAM systems are provided. A first RAM system supplies functional release agent material having a relatively high concentration of functional chains (~O.05 to 0.3 mol %) to an elastomeric fuser member prior to a second RAM system which supplies release agent material having low functionally or no functionality. The elastomeric fuser member may contain metal oxide particles. The low functionality release agent is relatively non-reactive. Depending on whether the elastomeric member contains the metal oxide particles, the functional chains of the high concentration release agent material which are periodically supplied to the fuser roll surface either attach to the metal particles exposed at the surface of the fuser roll by chemical bonds or to the elastomeric material itself. The non-reactive chains adhere to the functional chains by much weaker physical (such as van der Waals) chains. The periodic application of the high concentration release agent material includes application for a relatively short duration at machine startup as well as periodically thereafter as needed.

20 Claims, 1 Drawing Sheet

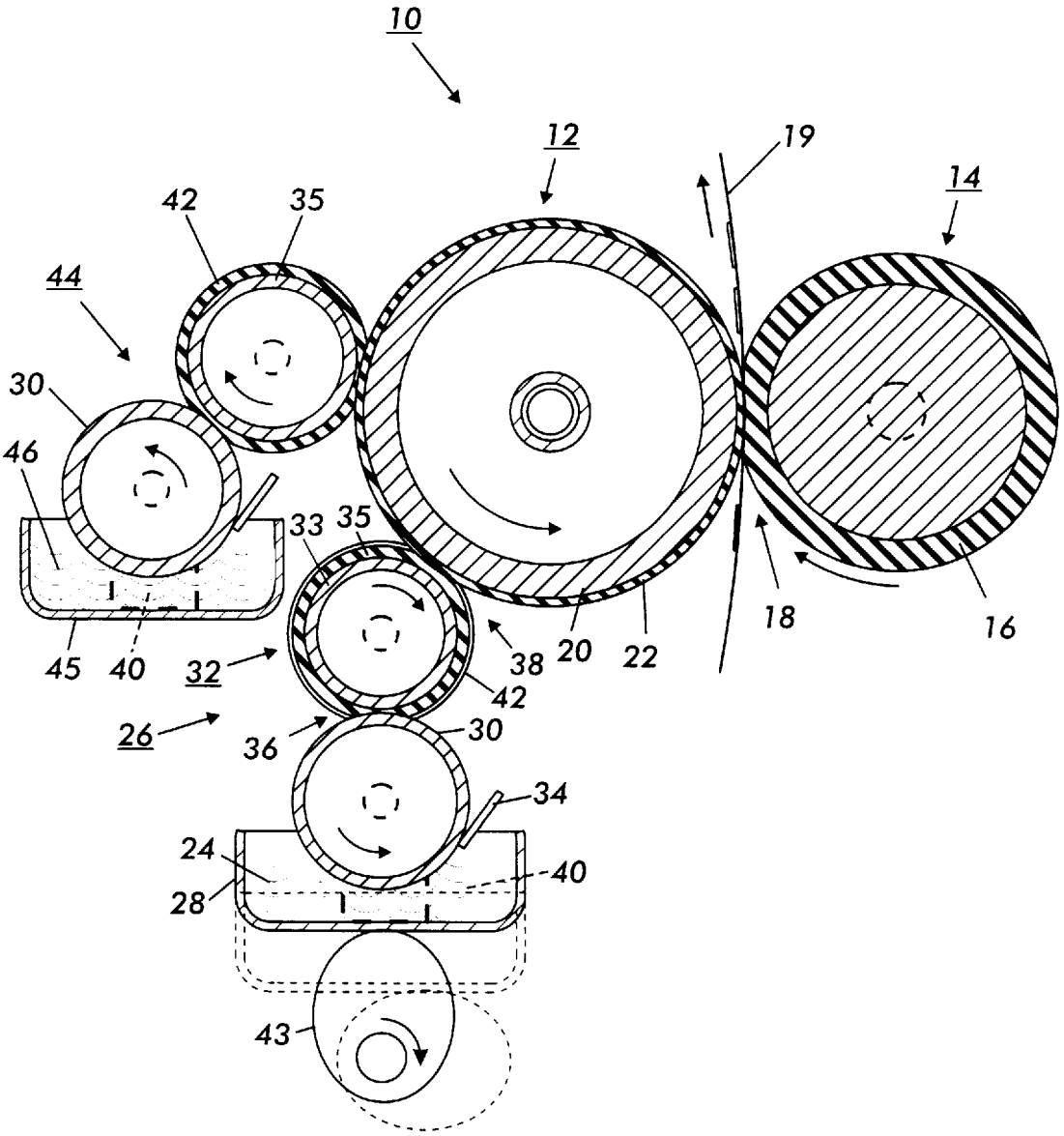
The Figure

DUAL OIL RELEASE AGENT MANAGEMENT SYSTEM

BACKGROUND OF THE INVENTION

This invention relates generally to a heat and pressure fuser for an electrophotographic printing machine, and more particularly the invention is directed to release agent application methods and apparatus therefor.

In a typical electrophotographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules either to a donor roll or to a latent image on the photoconductive member. The toner attracted to a donor roll is then deposited on a latent electrostatic images on a charge retentive surface which is usually a photoreceptor. The toner powder image is then transferred from the photoconductive member to a copy substrate. The toner particles are heated to permanently affix the powder image to the copy substrate.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip. In a Nip Forming Fuser Roll (NFFR) fuser, the heated fuser roll is provided with a layer or layers that are deformable by a harder pressure roll when the two rolls are pressure engaged. The length of the nip determines the dwell time or time that the toner particles remain in contact with the surface of the heated roll. In a Nip Forming Pressure Roll (NFPR) fuser the pressure roll is provided with a deformable outer layer which is deformable by the harder fuser roll.

The heated fuser roll is usually the roll that contacts the toner images on a substrate such as plain paper. In any event, the roll contacting the toner images is usually provided with an abhesive (low surface energy) material for preventing toner offset to the fuser member. Three materials which are commonly used for such purposes are PFA (PerFluoroAlkoxy resin), Viton™ and silicone rubber. All of these materials, in order to maintain their abhesive qualities, require release agents specific to the material.

The surface energy of Viton, compared to PFA or silicone rubbers is quite high. Therefore, ordinary release agents, which are suitable for PFA or silicone rubber surfaces, do not provide adequate release from Viton surfaces.

RAM systems designed for Viton™ type fusers, need functional release agents which bond reactively to the fuser roll surface, because non-reactive release agents do not adhere to Viton adequately. Such functional oils are actually dilute solutions of functional chains (containing groups such as mercapto, amino, etc.) in the conventional non-reactive silicone oil. The functional chains attach to the fuser roll surface by chemical bonds, and the non-reactive chains adhere to the functional chains by much weaker physical (such as van der Waals) chains. Although the functional chains are bonded to the roll, they are eventually removed by the harsh abrasive conditions encountered, and need to be periodically replaced. A certain minimum amount of functional chains (in the order of 0.05 to 0.3 mol %) are required, in order to completely fill the roll surface, without leaving any bare spots which can lead to release failure. Once the roll surface is completely covered with functional chains, only the non-reactive chains need to be replaced continuously as the fuser operates, except for replenishing the few functional chains, which are periodically removed from the surface. Therefore in the maintenance mode a far smaller fraction of functional chains is required than in the initial mode.

However, since current RAM systems using functional oils are limited to a single release agent formulation, they are forced to provide the relatively high level (~0.05 to 0.3 mol %) of the functional oils all the time, even in the maintenance mode. The extra functional chains are not bonded to the roll surface because there are no free sites available to them. They are, therefore, passed on to the paper, together with the non-reactive chains. This causes several problems: (1) Cost, because the functional oils are much more expensive than the non-reactive oils; (2) Write-on-copy problems; (3) Stick-on-copy problems, because the functional oils are much more resistant to adhesion than the non-reactive oil and (4) Fuser streaking on OverHead Projector (OHP) transparencies in color copiers/printers in some machines is also attributed to excess functional oil. Number 3 above seems to be related to the functional oils adhering more tenaciously to the paper because of chemical bonding. The stick-on-copy problems are severe enough to jeopardize customer acceptance of certain xerographic imaging machines.

Following is a discussion of prior art, incorporated herein by reference, which may bear on the patentability of the present invention. In addition to possibly having some relevance to the question of patentability, these references, together with the detailed description to follow, may provide a better understanding and appreciation of the present invention.

U.S. Pat. No. 3,934,547 granted to Jelfo et al on Jan. 27, 1976 and U.S. Pat. No. 4,065,585 granted to Jelfo et al on Dec. 27, 1977 disclose a contact fuser assembly for use in an electrostatic reproducing apparatus including an internally heated fuser roll structure comprising a rigid, thermally conductive core which is coated during operation of the assembly with a thin layer of a normally solid thermally stable material with subsequent application of a liquid release agent to the coated core. In the preferred embodiment of the invention the coating material comprises a fluorocarbon telomer such as Vydax 1000 and the liquid release agent comprises a liquid silicone oil.

U.S. Pat. No. 4,214,549 granted to Rabin Moser on Jul. 29, 1980 discloses a heat and pressure roll fusing apparatus for fixing toner images to copy substrates, the toner comprising a thermoplastic resin. The apparatus includes an internally heated, fuser roll cooperating with a backup or pressure roll to form a nip through which the copy substrates pass with the images contacting the heated roll. The heated fuser roll is characterized by an outer layer or surface which by way of example is fabricated from a silicon rubber or Viton™ material to which a low viscosity polymeric release fluid is applied. Release fluid is contained in a sump from which it is dispensed by means of a metering roll and a donor roll, the former of which contacts the release fluid in the sump and the latter of which contacts the surface of the heated fuser roll.

U.S. Pat. No. 5,219,612 granted to Patrick J. Finn et al on Jun. 15, 1993 discloses a method of using multilayered member for fusing thermoplastic resin toner images to a substrate in a fuser system of the type wherein a polymeric release agent having functional groups is applied to the surface of the fuser member. The multilayered fuser member has in sequential order a base support member, an adhesive layer comprising a copolymer of vinylidene fluoride and hexafluoropropylene and at least 20% by weight of the adhesive layer of a coupling agent comprising at least one organo functional silane and an activator, a tie coat layer of active ingredients comprising a copolymer of vinylidene fluoride and hexafluoropropylene and an outer elastomeric fusing surface comprising a copolymer of vinylidene fluoride and hexafluoropropylene and containing a metal oxide present in an amount sufficient to interact with a polymeric release agent having functional groups to provide an interfacial barrier layer between said fusing surface and toner.

U.S. Pat. No. 5,217,837 granted to Arnold W. Henry et al on Jun. 8, 1993 discloses a multilayered fuser member for fusing thermoplastic resin toner images to a substrate in a fuser system of the type wherein a polymeric release agent having functional groups is applied to the surface of the fuser member, the fuser member has a base support member, a thermally conductive silicone elastomer layer, an amino silane primer layer, an adhesive layer and a fluoroelastomer surface layer based on the copolymer of vinylidene fluoride and hexafluoropropylene, a metal oxide being present in the fusing surface layer to interact with the polymeric release agent to provide an interfacial barrier layer between the fusing surface and the toner and substantially unreactive with the elastomer.

U.S. Pat. No. 5,017,432 granted to Clifford 0. Eddy, on Oct. 29, 1991 relates to a fuser member and fuser system of a type wherein a polymeric release agent having functional groups supplied to the surface of the fuser member has an elastomer fusing surface comprising poly (vinylidenefluoride-hexafluoropropylene-tetrafluoroethylene) wherein the vinylidenefluoride is present in the amount less than 40 mole percent, a metal oxide is present in amounts sufficient to interact with the polymer release agent having functional groups to provide an interfacial barrier layer between the fusing surface and the toner and being substantially unreactive with the elastomer and wherein the elastomer is cured from a solvent solution thereof with a nucleophilic curing agent soluble in the solution and in the presence of less than 4 parts by weight of inorganic base per 100 parts by weight of polymer with the inorganic base being effective to at least partially dehydrofluorinate the vinylidenefluoride.

U.S. Pat. No. 5,531,813 granted Henry, et. al on Jul. 2, 1996 discloses a polyorgano amino functional oil release agent having at least 85% monoamino functionality per active molecule to interacts with the thermally stable FRM hydrofluoroelastomer surface of a fuser member of an electrostatographic apparatus to provide an interfacial barrier layer to the toner and a low surface energy film to release the toner from the surface is introduced herein.

U.S. Pat. No. 5,500,722 granted to Robert M. Jacobs on Mar. 19, 1996 relates to a Release Agent Management (RAM) system for a heat and pressure fuser for fixing black toner images in low and high volume imaging machines and also for fixing color images. An auxiliary oil supply is provided for applying extra oil to an oil impregnated web. The extra oil improves fuser roll release life in every application. Also, enables color fusing which requires higher oil application rates.

BRIEF SUMMARY OF THE INVENTION

According to the intents and purposes of the present invention, the aforementioned problems are solved by delivering a relatively high concentration of functional chains (in the order of 0.05 to 0.3 mol %) in an initial or startup mode of operation of a heat and pressure fuser, and a much lower concentration preferably zero functional chains in the maintenance or run mode. This will provide the necessary release performance at a lower cost, without the write-on-copy, the transparency streaking and the stick-on-copy problems currently encountered with the use of only functional release agent materials.

This is achieved by the present invention by the provision of two RAM systems, one of which delivers the higher concentration functional chains and the other which delivers a lower, preferably zero concentration, of functional chains. In one possible embodiment, the high concentration RAM system would be actuated initially (say, at machine startup) and then briefly at periodic intervals (say, every 100 to 1000 prints, or as needed). This will provide a low or no concentration of functional chains in the maintenance mode, so there will be much fewer of them escaping on the paper. This will reduce or eliminate the write- on-copy and stick-on-copy problems cited earlier, and the running costs will be lower because of the cheaper non-reactive oil. Fuser streaks may also be reduced. An added benefit is that the functional oil in the initial-mode RAM system would stay much cooler and hence not be susceptible to gelling.

DESCRIPTION OF THE DRAWING

The FIGURE is a schematic representation of a heat and pressure fuser incorporating the invention.

DESCRIPTION OF THE PREFERRED EMBODIMENT(S) OF THE INVENTION

While the present invention will be described in connection with a preferred embodiment thereof, it will be understood that it is not intended to limit the invention to this embodiment. On the contrary, it is intended to cover all alternatives, modifications, and equivalents as may be included within the spirit and scope of the invention as defined by the appended claims.

Disclosed in the FIGURE is a heat and pressure fuser structure 10 incorporating certain features of the present invention. As disclosed in the FIGURE, the structure 10 comprises a Nip Forming Pressure Roll (NFPR) fuser including a heated fuser roll member 12 and a pressure roll 14. In a NFPR fuser, the pressure roll comprises a deformable layer 16 which under pressure applied between the harder fuser roll and softer pressure roll deforms to form an elongated nip 18 through which a substrate 19 such as plain paper carrying toner images passes. As will be appreciated, the present invention is also suitable for Nip Forming Fuser Roll (NFFR) fusers wherein the heated fuser member comprises the deformable outer layer.

The heated fuser roll member 12 comprises a rigid, thermally conductive core 20 supporting an outer elastomeric layer 22. The layer 22 preferably comprises Viton™ a fluoroelastomer material based on the copolymer of vinylidene fluoride and hexafluoropropylene. The layer 22 may contain metal oxide particles which interact with a polymeric release agent material 24 to provide an interfacial barrier layer between the fusing surface and the toner. The layer 22 is fabricated in accordance with well known processes. The release agent material 24 comprises a functional release agent material containing a relatively high concentration (in the order of 0.05 to 0.3 mol %) of functional chains which attach to the metal oxide particles.

The elastomeric layer may also contain metal oxide particles. In the case of a metal oxide filled Viton™ layer 22, mercapto functional oil is used for interaction with the oxide particles. In this case, the mercapto functional oil bonds to the oxide particles. When the layer 22 is not filled with metal oxide particles an amino functional oil is used. In this case, the amino functional oil bonds with the Viton™. The amino functional oil may also be used with a layer 22 which contains oxide particles.

The functional release agent material 24 is supplied to the surface of the fuser roll member 12 by means of a first RAM system 26 comprising a sump 28 containing a quantity of the polymeric release agent material 24.

Suitable release agent materials for use in RAM system 26 comprise a functionalized polymeric release agent, such as mercapto-functional polyorganosiloxane. The metal oxide particles contained in a metal oxide filled elastomer layer 22 are in an amount sufficient to interact with the polymeric release agent 24 which comprises sufficient (i.e. 0.05 to 0.3 mol %) functional chains to provide an interfacial barrier layer between said fusing surface and toner.

This RAM system also comprises a metering roll 30 and donor roll 32 for conveying release agent material from the sump 28 to the surface of the fuser roll 12. A metering blade 34 contacting the metering roll in a chiseling orientation serves to meter the release agent material on the surface of the metering roll.

The metering roll 30 is partially immersed in the release agent material 24 and is supported for rotation such that it is contacted by the donor roll 32 which, in turn, is supported so as to be contacted by the heated roll structure 12. As can be seen, the orientation of the rolls 30 and 32 is such as to provide a path for conveying material 24 from the sump to the surface of the heated roll structure 12. The metering roll is preferably a nickel or chrome plated steel roll having a 4–32 AA finish. The metering roll has an outside diameter of 1.0 inch. As mentioned above, the metering roll is supported for rotation, such rotation being derived by means of the positively driven heated roll structure 12 via the rotatably supported donor roll 32. In order to permit rotation of (at a practical input torque to the heated roll structure 12) the metering roll 30 in this manner the donor roll 32 comprises a rigid core 33 carrying a deformable layer 35 which forms a first nip 36 between the metering roll and the donor roll and a second nip 38 between the latter and the heated roll. The nips 36 and 38 also permit satisfactory release agent transfer between the rolls and roll structure. Suitable nip lengths are about 0.10 inch.

A wick 40 is fully immersed in the release agent and contacts the surface of the metering roll 30. The purpose of the wick is to provide an air seal which disturbs the air layer formed at the surface of the roll 30 during rotation thereof. If it were not for the function of the wick, the air layer would be coextensive with the surface of the roll immersed in the release agent thereby precluding contact between the metering roll and the release agent.

The metering or wiper blade 34 preferably fabricated from Viton is ¾×1/8 in cross section has a length coextensive with the metering roll. The edge of the blade contacting the metering roll has a radius of 0.001–0.010 inch. The blade functions to meter the release agent picked up by the roll 30 to a predetermined thickness, such thickness being of such a magnitude as to result in several microliters of release agent consumption per copy. The donor roll 32 has an outside diameter of 1.0 inch when the metering roll's outside diameter equals 1.0 inch. It will be appreciated that other dimensional combinations will yield satisfactory results. For example, 1.5 inch diameter rolls for the donor and metering rolls have been employed. The deformable layer 35 of the donor roll preferably comprises overcoated silicone rubber. However, other materials may also be employed.

A thin sleeve 42 on the order of several mils, constitutes the outermost surface of the roll 32, the sleeve material comprises Teflon, Viton or any other material that will impede penetration of silicone oil into the silicone rubber. While the donor rolls may be employed without the sleeve 42, it has been found that when the sleeve is utilized, the integrity of the donor roll is retained over a longer period and contaminants such as lint on the heated roll 12 will not readily transfer to the metering roll 30. Accordingly, the material in the sump will not become contaminated by such debris.

A camming mechanism generally indicated by reference character 43 serves to effect selective movement of the RAM system 26 such that the donor roll 32 contacts the fuser outer layer 22 at the appropriate times and does not contact it during run mode.

A second RAM system 44 comprises a sump 45 containing a polymeric release agent material such as silicone oil 46. The silicone oil 46 comprises either a non-functional or non-reactive release agent material or a functional release agent material having a relatively low concentration of functional chains. The silicone oil 46 is applied to the fuser roll member 12 during copy runs while the release agent material 24 is applied intermittently, initially at machine startup and periodically as needed throughout the life of the fuser. A typical operation scenario would be to have the release agent material 24 applied for ten copies and then have the RAM system 26 disengaged for between 10 to 1000 copies.

The liquid release agent 46 may be selected from those materials which have been conventionally used in prior art devices. Typical release agents include a variety of conventionally used silicone oils including both functional oil with a low concentration of functional chains and non-functional oils. Thus, the release agent is selected to be compatible with the rest of the system pursuant to the intents and purposes of the invention. A particularly preferred release agent is a unimodal low molecular weight polysiloxane having a viscosity of about 11,000 centistokes. The RAM system also comprises a metering roll 30, donor roll 32, wick 40 and blade 34.

An important aspect of this invention is that the oil 46 being applied to the heated fuser roll contains a low concentration of functional chains or no functional chains to insure that less functional chains are applied thereby than when the oil 24 is applied.

We claim:

1. A heat and pressure fuser structure for use in an imaging apparatus, said fuser structure comprising:

a heated fuser member;

a non-heated fuser member supported for pressure contact with said heated fuser member;

an elastomeric material forming an outer layer of said heated fuser member;

a first release agent management system for supplying functional release agent material having a relatively high concentration of functional chains to said outer layer; and a second release agent management system for supplying a lesser reactive release agent material to said outer layer.

2. A heat and pressure fuser structure according to claim 1 including a structure for effecting selective application of release agent material contained in said first release agent management system.

3. A heat and pressure fuser structure according to claim 2 wherein the concentration of said functional chains of said functional release agent material having a relatively high concentration of functional chains is equal to approximately 0.05 to 0.3 mol %.

4. A heat and pressure fuser structure according to claim 1 wherein said second release agent management system comprises a concentration of functional chains less than said first release agent management system.

5. A heat and pressure fuser structure according to claim 4 wherein the concentration of said functional chains of said functional release agent material having a relatively high concentration of functional chains is equal to approximately 0.05 to 0.3 mol %.

6. A heat and pressure fuser structure according to claim 5 wherein a member for applying said release agent material of said first release agent management system is actuated periodically.

7. A heat and pressure fuser structure according to claim 6 wherein said member for periodically applying said first release agent material is actuated upon startup of said imaging apparatus.

8. A heat and pressure fuser structure according to claim 7 wherein said member for periodically applying said release agent material is operable for a relatively short duration after startup of said imaging apparatus.

9. A heat and pressure fuser structure according to claim 1 wherein said elastomeric material contains metal oxide particles.

10. A heat and pressure fuser structure according to 9 wherein said first release agent management system comprises a dilute solution of functional chains containing mercapto groups.

11. A heat and pressure fuser structure according to claim 1 wherein said first release agent management system comprises a dilute solution of functional chains containing amino groups.

12. A method of fixing toner images to substrates in an imaging apparatus, said method including the steps of:

supporting a heated fuser member in pressure contact with a non-heated fuser member;

providing said heated fuse member with an elastomeric outer layer;

supplying a first functional release agent material having a relatively high concentration of functional chains to said outer layer; and subsequent to supplying said first functional release agent material, supplying a second release agent material having less functional chains than said first functional release agent material; and passing a substrate carrying toner images in contact with said heated fuser member.

13. The method according to claim 12 wherein said step of supplying a first functional release agent material is effected upon startup of said imaging apparatus.

14. The method according to claim 13 wherein said step of supplying a first functional release agent material is effected periodically after startup of said imaging apparatus.

15. The method according to claim 14 wherein said step of supplying a first functional release agent material having a relatively high concentration of functional chains is effected with functional release agent material having a concentration of functional chains in the order of 0.05 to 0.3 mol %.

16. The method according to claim 12 wherein said elastomeric material contains metal oxide particles.

17. The method according to claim 12 wherein said first functional release agent material comprises a dilute solution of functional chains containing amino groups.

18. The method according to claim 15 wherein said step of supplying a first functional release agent material upon startup of said imaging apparatus is effected for a relatively short duration.

19. The method according to claim 17 wherein said step of supplying a first functional release agent material is effected periodically after startup of said imaging apparatus.

20. The method according to claim 19 wherein said heated and non-heated fuser members comprise roll structures.

* * * * *